US007802348B2

(12) United States Patent
Knäbel et al.

(10) Patent No.: US 7,802,348 B2
(45) Date of Patent: Sep. 28, 2010

(54) DEVICE FOR STRETCHING WEBS OF MATERIAL TRANSVERSELY TO THEIR TRAVEL DIRECTION

(76) Inventors: Holmer Knäbel, Beim Kloster Dohren 32A, D-21614 Buxtehude (DE); Horst Knäbel, Friedenstrasse 10a, D-40667 Meerbusch (DE)

( * ) Notice: Subject to any disclaimer, the term of this patent is extended or adjusted under 35 U.S.C. 154(b) by 557 days.

(21) Appl. No.: 11/894,030

(22) Filed: Aug. 17, 2007

(65) Prior Publication Data

US 2008/0047115 A1 Feb. 28, 2008

(30) Foreign Application Priority Data

Aug. 21, 2006 (DE) ..... 20 2006 012 802 U

(51) Int. Cl.
*D06C 3/06* (2006.01)

(52) U.S. Cl. ..... 26/99

(58) Field of Classification Search ..... 26/99, 26/100, 102, 97, 98, 75, 51.3, 101–103; 492/39, 492/40, 27; 242/615.2
See application file for complete search history.

(56) References Cited

U.S. PATENT DOCUMENTS

| | | | | | |
|---|---|---|---|---|---|
| 1,660,224 | A | * | 2/1928 | Farrell | 26/101 |
| 1,748,275 | A | * | 2/1930 | Birch | 26/75 |
| 1,927,849 | A | * | 9/1933 | Roberts | 26/77 |
| 2,198,656 | A | * | 4/1940 | Cohn et al. | 226/23 |
| 2,771,657 | A | * | 11/1956 | Gageant | 26/104 |
| 2,823,443 | A | * | 2/1958 | Umstott | 26/104 |
| 3,665,572 | A | * | 5/1972 | Robertson | 26/104 |
| 3,719,975 | A | * | 3/1973 | Illarionov et al. | 26/51.3 |
| 4,146,947 | A | * | 4/1979 | Richter | 26/104 |
| 4,239,142 | A | * | 12/1980 | Schonmeier et al. | 226/194 |
| 4,410,122 | A | * | 10/1983 | Frye et al. | 242/615.2 |
| 5,273,197 | A | * | 12/1993 | Wenk | 226/190 |

* cited by examiner

*Primary Examiner*—Amy B Vanatta
(74) *Attorney, Agent, or Firm*—Lucas & Mercanti, LLP; Klaus P. Stoffel

(57) ABSTRACT

A device for stretching webs of material transversely to a travel direction thereof, includes at least one rotary stretcher extending transversely to the travel direction of the web of material. The stretcher is composed of at least two round tubes which are aligned axially with each other and are supported by ball-and-socket joints on links. The links are mounted adjustably on a base frame.

12 Claims, 3 Drawing Sheets

DEVICE FOR STRETCHING WEBS OF MATERIAL TRANSVERSELY TO THEIR TRAVEL DIRECTION

BACKGROUND OF THE INVENTION

1. Field of the Invention

The present invention relates to a device for stretching webs of material transversely to their travel direction, which device includes at least one rotary stretcher extending transversely to the travel direction of the web of material.

2. Description of the Related Art

During the processing or treatment of webs of material made of textile, paper, plastic, metal in the form of foils, minerals in the form of nonwovens, and the like, or combinations of these materials, longitudinal wrinkles can develop in the web of material, which interfere with the technological process sequence —for example, during the printing of a web of material—and also adversely affect the straightening and coiling operation. Furthermore, it often happens that a web of material must be cut, and the resulting individual webs must be separated from one another.

To solve these problems, so-called rotary stretchers are used, over which the web of material is guided, and which have the function of stretching the web of material transversely to its travel direction. These rotary stretchers can have various configurations.

Rotary stretchers in the form of thread rollers are known; these rollers are provided over half their length with a right-handed thread and over the other half with a left-handed thread, which are preferably round threads. The web of material running over a thread roller of this type is stretched transversely to its travel direction by the flights, which press the web toward the outside at both ends. The pitch of the threads, which are configured for maximum stretching of the web of material, cannot be changed, which means that the web of material will inevitably slide over the threads and thus be subjected to abrasion.

Another type of stretcher is the so-called rubber cord stretcher, in which rubber cords are embedded in longitudinal grooves in the rollers and thus extend transversely to the web of material. Near the ends of the rollers, these rubber cords are connected to obliquely adjustable disks, which rotate along with the stretchers, so that each of the rubber cords is first stretched over an angle of 180° almost sinusoidally and then relaxed again in the same way over the following angle of 180°. This roller is used in such a way that the web of material rests only on the area of the stretching rubber cords. Due to this configuration and the preset finite number of rubber cords that result from this design, the web of material is not continuously stretched but rather only discontinuously stretched. Moreover, sliding friction occurs in this type of roller, and thus frictional wear between the roller and the rubber cords and between the cords and the web of material also occurs. Due to the friction of the rubber cords in the longitudinal grooves and the molecular friction inside the rubber cords, the required drive torque is so high that it can hardly be applied by the web of material running over the rubber cords. This means that rollers of this type cannot be used without an additional drive adjusted to the speed of the web of material.

Furthermore, it is known that stretchers can be so-called bow rollers or segmented bow rollers with an adjustable radius of curvature. It is this curvature which produces the transverse stretching of the web of material. Bow rollers of this type have a rigid shaft and an elastic sleeve that usually consists of rubber or a cylinder coated with rubber. Due to the high flexing work in the interior of the sleeve, these rollers require a suitable drive, since the necessary torque arising from the coefficient of friction between the rubber and the web of material cannot be applied by the web of material traveling over the rubber. A further disadvantage is that with a high coefficient of friction between the rubber and the web of material, there is also an increase in abrasion between the roller and the web of material longitudinally and transversely to the travel direction.

Finally, it is also known that a roller provided with bristles can be used for the transverse stretching of a web of material. These bristles can damage the web of material, so that rolls of this type cannot be used for sensitive materials such as thin plastic films. The degree of transverse stretching is relatively limited and can be produced for only a limited time due to the gradual weakening of the bristles.

SUMMARY OF THE INVENTION

Therefore, the primary goal of the invention is to create a device for stretching running webs of material transversely to their travel direction, which device runs very smoothly, places practically no stress on the web of material to be stretched and thus is also suitable for the transverse stretching of thin plastic films and metal foils, can be optimally adjusted to the technological criteria, and has such a small moment of inertia that it can readily follow the changes in speed that arise in the web of material.

To achieve this goal, it is proposed that, in a device of the general type described above, the stretcher consist of at least two round tubes, which are aligned axially with each other and are supported by ball-and-socket joints on links, which in turn are mounted adjustably on a base frame.

This type of device for the transverse stretching of a running web of material guarantees that the web of material has practically no stress on it, that its quality is not impaired, and that the technological criteria can be optimally adjusted. The use of two roller bearings for each journal in the inner ring of the ball-and-socket joint prevents any jamming which could be caused by tilting, so that the device runs extremely smoothly. Due to the use of thin-walled round tubes, the moment of inertia is so small that the device can readily follow any changes in speed that may arise in the web of material.

The various features of novelty which characterize the invention are pointed out with particularity in the claims annexed to and forming a part of the disclosure. For a better understanding of the invention, its operating advantages, specific objects attained by its use, reference should be had to descriptive matter in which there are described preferred embodiments of the invention.

DESCRIPTION OF THE PREFERRED EMBODIMENTS

Figure 1:
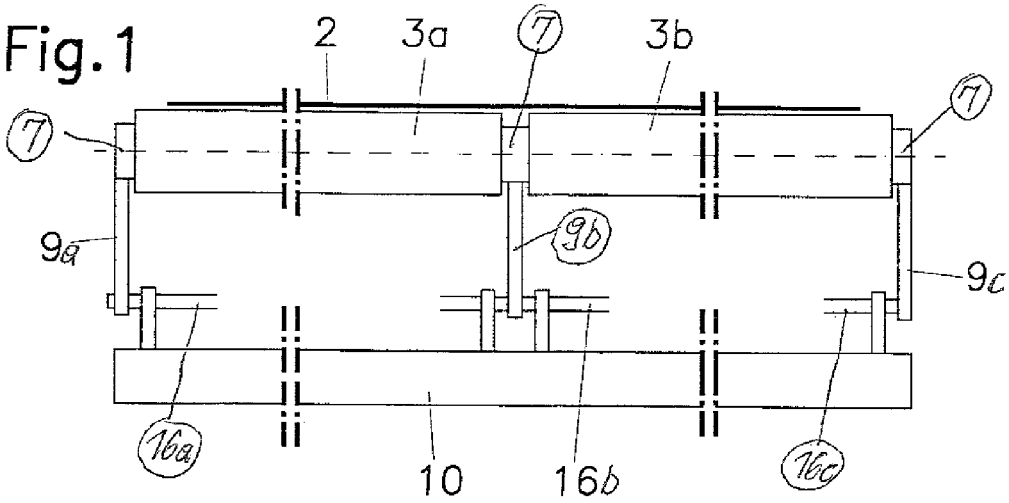
FIG. 1 is a front elevational view of a device of the invention in its initial position.
Figure 2:
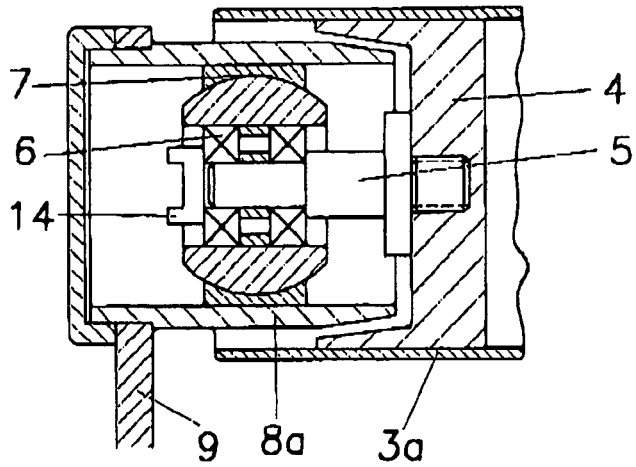
FIG. 2 is an enlarged view of a section through an outer bearing of the device of FIG. 1.

FIGS. 1 and 2 show a simplified version of a device 1, which can be used for the transverse stretching of a web of material 2, which runs in the direction of arrow 2*a*. The material web 2 can consist of textile, paper, plastic, metal in the form of foil, minerals in the form of nonwovens, and the like, or combinations of these materials.

The device 1 is composed essentially of two thin-walled round tubes 3*a*, 3*b*, which are aligned axially with each other and which are connected by filler pieces 4, inserted in both ends. Each filler piece carries a journal 5. These journals 5 are supported in the inner ring of ball-and-socket joints 7 by roller bearings 6, which are advantageously designed as ball bearings. In this regard, it is advantageous for the roller bearings 6 to be axially fixed in the inner rings of the ball-and-socket joints 7. The ball-and-socket joints 7 are mounted in sleeves 8*a*, 8*b*, which in turn are supported by the links 9. It is advantageous for the links 9 located at the inner ends of the round tubes 3*a*, 3*b* and thus adjacent to be joined to each other. For example, all of the links 9 can be mounted on the base frame 10 in such a way that their positions can be adjusted.

The round tubes 3*a*, 3*b*, which are shown aligned in their initial position in FIG. 1, can each be moved into an angled position relative to the web of material 2 by adjusting the links 9 on the base frame 10. These angled positions of the round tubes 3*a*, 3*b* produce axial forces, which, when they are outwardly directed at both ends, stretch the web of material 2 transversely to its travel direction. The degree of stretching depends on the size of the angle, on the coefficient of friction between the surface of the round tubes 3*a*, 3*b* and the web of material 2, and on the angle by which the web of material 2 wraps around the round tubes 3*a*, 3*b*.

To create a fixed support for the centering of the web of material 2, it is advantageous for the outer rings of the ball-and-socket joints 7 on the links 9 which are connected to each other to be axially fixed in the ball-and-socket joints 7, whereas the other ball-and-socket joints 7 can remain as loose bearings with freedom of axial movement in the sleeves 8*a*. It is not normally necessary to take measures to prevent the rotation of the ball-and-socket joints 7 if their friction is well above that of the roller bearings 6 mounted in them.

The journals 5 of the round tubes 3*a*, 3*b* opposing each other at their end surfaces are connected to each other by an elastic coupling 11. An elastic coupling of this type must be able to compensate an angular offset of the journals of up to 20°, for example, and a displacement of 4 mm to 10 mm. The elastic coupling illustrated in FIG. 3 consists of a helical spring 12, which is specially designed for this purpose and which is inserted between two end pieces 13.

As an auxiliary measure, the round tubes 3*a*, 3*b* can be driven by way of driver formations 14 assigned to the outer journals 5. In this regard, it is possible to drive each round tube 3*a*, 3*b* individually or, when an elastic coupling 11 is used, to drive both round tubes 3*a*, 3*b* jointly from both ends. Thus, if necessary, even the small moment of friction of the roller bearings 6 can be compensated by a relatively small d.c. motor (not shown) by operating this d.c. motor at nominal current and by supplying it with only a limited and adjustable current as needed based on the friction moment.

Figure 4:
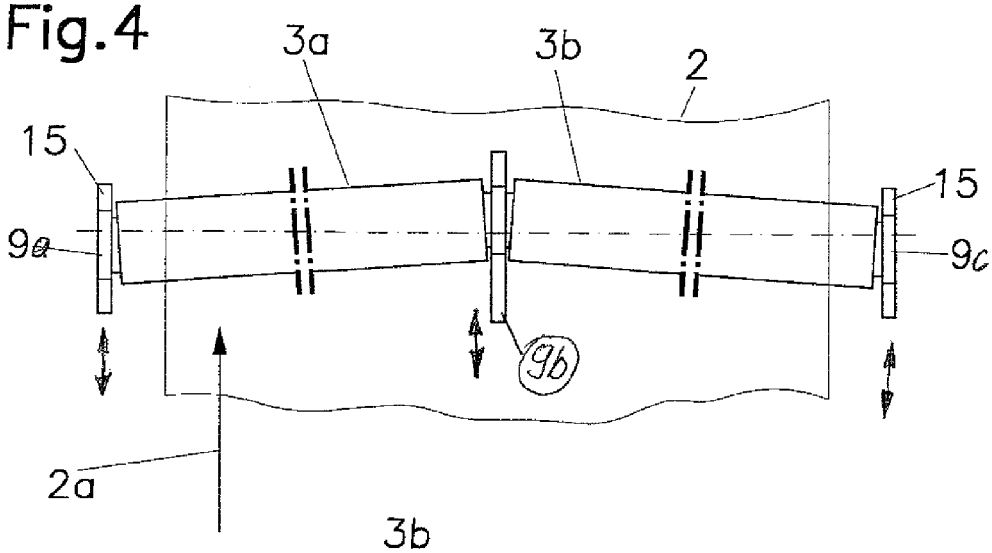
FIG. 4 is a top view of the device of FIG. 1 with rail-mounted links in an operating position.

FIG. 4 is a top view of a device 1 in its operating position. The links 9 are mounted in rails 15. The links 9 can be moved, for example, by spindles (not shown), so that the desired angled position of the round tubes 3*a*, 3*b* is obtained. Normally, the angles of the two round tubes 3*a*, 3*b* should be the same in order to stretch the web of material 2 symmetrically towards both ends. However, there can also be individual cases that necessitate nonsymmetrical transverse stretching of a web of material 2. This, too, is easily and immediately possible with the device 1 of the invention, in contrast to all previously known stretchers.

Figure 5:
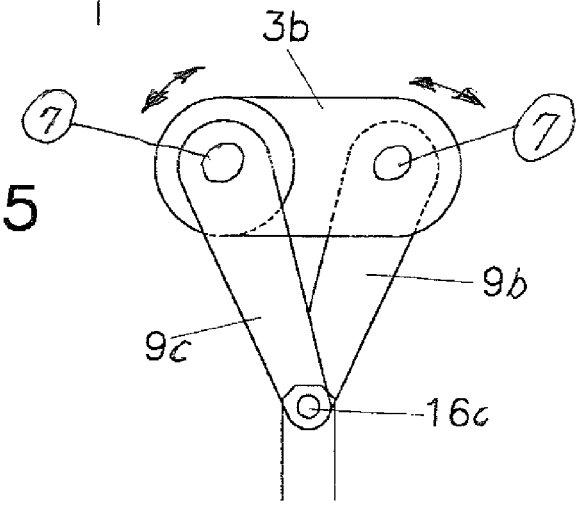
FIG. 5 is a side view of FIG. 4 with the links swung into an operating position.

FIG. 5 shows a side view of the device of FIG. 1, likewise in its operating position. In this case, however, the links 9 are pivot arms. The round tubes 3*a*, 3*b* are brought into their angled position by pivoting the links 9 to the desired pivot angle. Step bearings, which are merely suggested in FIG. 1 and which are mounted on the base frame 10, can be used to support the pivot arms 9. In this regard, the links 9, which are designed as arms, can be pivoted around at least one shaft 16 supported on the base frame. In an embodiment of this type as well, the arm-like links 9 can be moved individually, for example, by spindles, or synchronously, for example, by a mechanism consisting of two worm gears and a pair of gear wheels engaging with the worms of the worm gears, which can be done either manually or mechanically.

Figure 3:
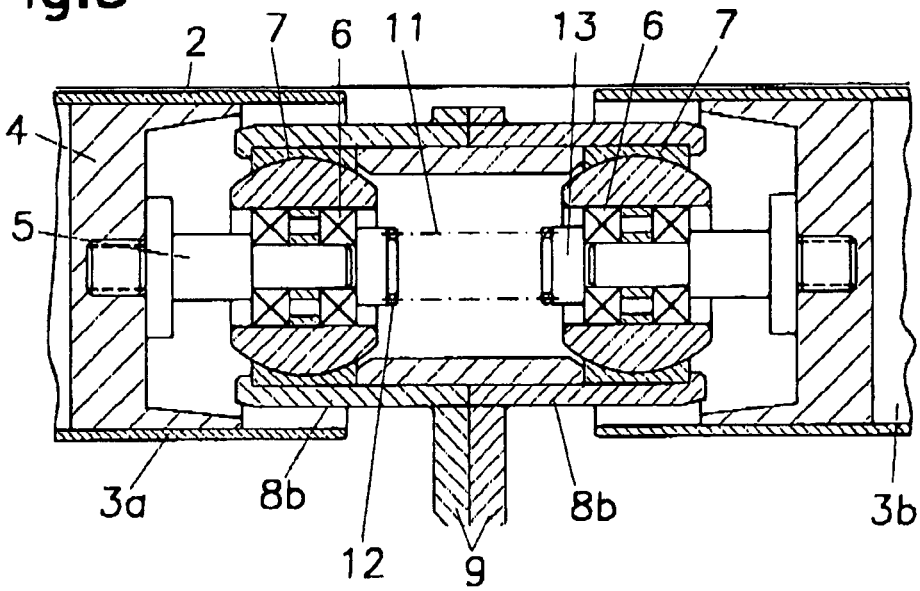
FIG. 3 is an enlarged view of a section through a center bearing of the device of FIG. 1.
Figure 6:
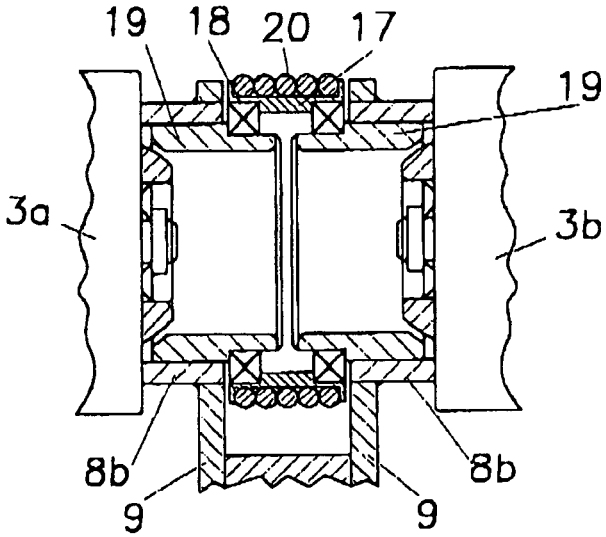
FIG. 6 shows a different view, only partially cut away, of a bearing of the device with an intermediate ring.

FIG. 6 shows a configuration that largely conforms to FIG. 3, in which a ring 17 is mounted between the two round tubes 3*a*, 3*b*. The ring 17 is supported by two roller bearings 18 on two intermediate rings 19 inserted in the sleeves 8*b*. This ring 17, which can have a variable length, offers the possibility of additionally centering the web of material and—if this should be necessary—of configuring the device 1 in such a way that the web of material 2 is stretched only at its edges. For this purpose, the surface of the round tubes 3*a*, 3*b* and of the ring 17 can be designed in various ways. It can be advantageous to polish or to profile the surfaces or to cover them with a rubber blanket. In FIG. 6, for example, five O-rings 20 are mounted on the ring 17, which significantly increase the coefficient of friction with respect to the web of material 2, compared, for example, to the polished surfaces of the round tubes 3*a*, 3*b*, and optimally center the web of material 2 by the profile formed by the O-rings 20. In addition, the gap between the round tubes 3*a*, 3*b* that support the web of material 2 is considerably reduced by the introduction of a ring 17 of this type.

Figure 7:
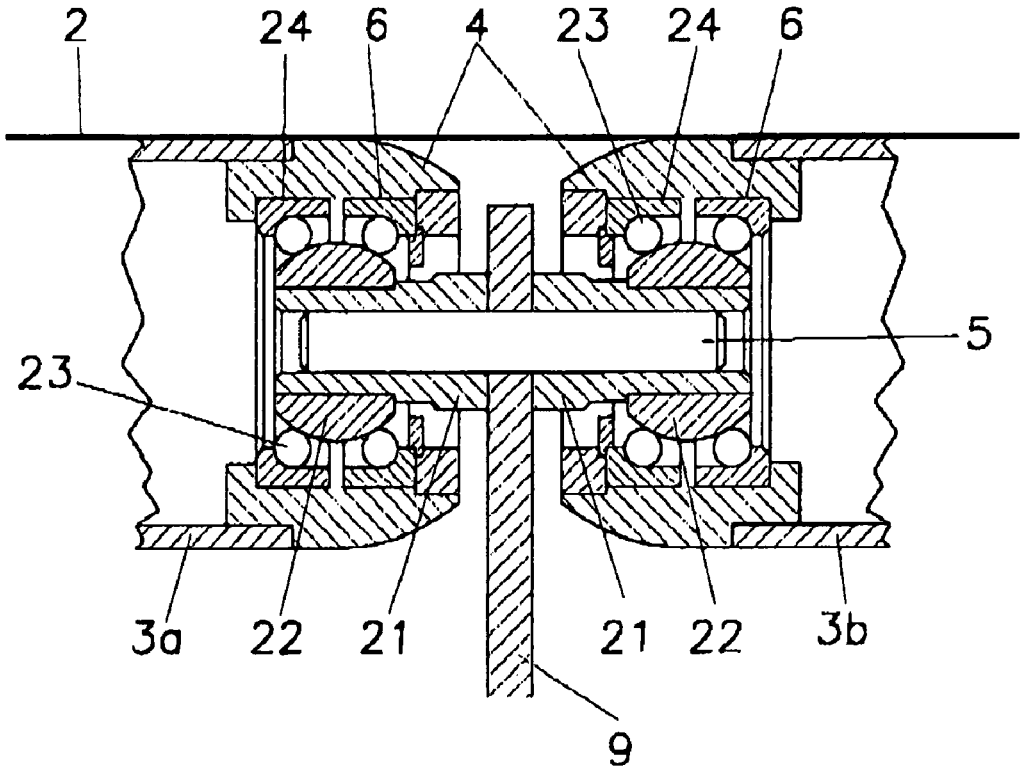
FIG. 7 shows a different bearing corresponding to FIG. 3.

FIG. 7 also shows a configuration that largely corresponds to FIG. 3, in which only one pivot arm 9 is located between the two round tubes 3*a*, 3*b*. The arm 9 in this case carries a single continuous journal 5. Each of its two ends extends into one of the round tubes 3*a*, 3*b*, and a slightly stepped bearing sleeve 21 is mounted nonrotatably on each end. On each bearing sleeve 21, a roller bearing 6 is mounted, which here consists of an inner ring bearing 22 similar to a ball joint with two ball cages with balls 23 and two angular ball bearing outer rings 24. In the illustrated case, these roller bearings 6 are each mounted in a filler piece 4, which in turn is held by the ends of the round tubes 3*a*, 3*b*. The filler pieces 4, which are also located on the outer ends of the round tubes 3*a*, 3*b*, are rounded towards their free end. It is advantageous for the radius of this rounding to be exactly as large as the radius of the round tubes 3*a*, 3*b*. Due to the roundings shown in FIG. 7, but also due to the roundings of the filler pieces 4 present on the outer ends of the round tubes 3*a*, 3*b*, the web of material is guided in all possible angular position in the same manner as is the case in the middle region of the round tubes 3*a*, 3*b*. Consequently marks on the material web 2 are avoided.

The roller bearings 7 described here have a simple design and can be subjected to relatively large loads. The coupling between the two round tubes 3*a*, 3*b* described with reference to FIGS. 3 and 6 was omitted here. This function can also be taken on by the web of material 2 itself.

While specific embodiments of the invention have been described in detail to illustrate the inventive principles, it will be understood that the invention may be embodied otherwise without departing from such principles.

We claim:

1. A device for stretching webs of material transversely to a travel direction thereof, the device comprising at least one rotary stretcher extending transversely to the travel direction of the web of material, wherein the stretcher comprises at least two round tubes (3*a*, 3*b*) which are aligned axially with each other and are supported by ball-and-socket joints (7) on separate links (9), wherein the links (9) are mounted adjustably on a base frame (10).

2. The device according to claim 1, wherein the links (9) are movable individually or in pairs in the longitudinal direction of the web of material (2).

3. The device according to claim 1, wherein the links (9) are supported in such a way that they can be displaced or pivoted.

4. The device according to claim 1, wherein the links (9) are pivot arms and, to form an angled position of the round tubes (3*a*, 3*b*), are movable manually or mechanically around their axis and can be mechanically or electrically coupled to each other.

5. The device according to claim 4, wherein the links (9) have a variable length.

6. The device according to claim 1, wherein a position of the base frame (10) is adjustable transversely to the travel direction of the web of material (2).

7. The device according to claim 1, wherein the base frame (10) is pivotable around its longitudinal axis.

8. The device according to claim 1, wherein the base frame (10) is raisable or lowerable at one end relative to the web of material (2).

9. The device according to claim 1, wherein surfaces of the round tubes (3*a*, 3*b*) are either the same or different from each other.

10. The device according to claim 1, wherein the tubes are supported in the ball-and-socket joints by roller bearings (6) that are angular ball bearings supported on a ring bearing (22).

11. The device according to claim 1, and further comprising a ring (17) mounted between the two round tubes (3*a*, 3*b*).

12. The device according to claim 11, wherein surfaces of the ring (17) and the tubes (3*a*, 3*b*) are the same or different from each other.

* * * * *